US009140153B2

(12) United States Patent
Valencia

(10) Patent No.: US 9,140,153 B2
(45) Date of Patent: Sep. 22, 2015

(54) ENGINE SYSTEM HAVING A BACKFLOW VALVE AND METHOD FOR OPERATION THEREOF

(71) Applicant: Ford Global Technologies, LLC, Dearborn, MI (US)

(72) Inventor: Frank Acierno Valencia, Canton, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 153 days.

(21) Appl. No.: 13/910,805

(22) Filed: Jun. 5, 2013

(65) Prior Publication Data

US 2014/0360454 A1 Dec. 11, 2014

(51) Int. Cl.

| | |
|---|---|
| ***F01M 1/04*** | (2006.01) |
| ***F01M 11/02*** | (2006.01) |
| ***F01M 13/02*** | (2006.01) |
| *F02B 75/02* | (2006.01) |
| *F01M 1/16* | (2006.01) |

(52) U.S. Cl.

CPC ..... *F01M 11/02* (2013.01); *F01M 13/028* (2013.01); *F01M 1/04* (2013.01); *F01M 1/16* (2013.01); *F02B 2075/025* (2013.01); *F02B 2075/027* (2013.01)

(58) Field of Classification Search

CPC ..... F01M 1/04; F01M 1/16; F01M 11/02; F02B 2075/027; F02B 2075/025

USPC ..... 123/196 CP

See application file for complete search history.

(56) References Cited

U.S. PATENT DOCUMENTS

| | | | | |
|---|---|---|---|---|
| 4,499,916 | A | 2/1985 | Hanson et al. | |
| 5,144,978 | A | 9/1992 | Brown et al. | |
| 5,347,973 | A * | 9/1994 | Walker, Jr. | 123/574 |
| 6,695,286 | B1 * | 2/2004 | Florio et al. | 251/315.16 |
| 6,994,078 | B2 | 2/2006 | Roberts et al. | |
| 7,380,545 | B2 | 6/2008 | Shieh et al. | |
| 8,347,865 | B2 | 1/2013 | Valencia et al. | |
| 2003/0101960 | A1 * | 6/2003 | Tsuchiya et al. | 123/196 R |
| 2007/0107691 | A1 | 5/2007 | Yoshinaga et al. | |
| 2011/0252974 | A1 * | 10/2011 | Verdegan et al. | 96/178 |

* cited by examiner

*Primary Examiner* — Lindsay Low
*Assistant Examiner* — Charles Brauch
(74) *Attorney, Agent, or Firm* — Greg Brown; Alleman Hall McCoy Russell & Tuttle LLP

(57) ABSTRACT

An engine system is described. The engine system includes an oil drain passage in fluidic communication with an oil separator. The engine system further includes a backflow valve positioned at an outlet of the oil drain line, the backflow valve having a first configuration where the valve provides a predetermined amount of oil backflow into the oil drain passage and a second configuration where the valve inhibits oil backflow into the oil drain passage.

20 Claims, 6 Drawing Sheets

ENGINE SYSTEM HAVING A BACKFLOW VALVE AND METHOD FOR OPERATION THEREOF

FIELD

The present disclosure relates a positive crankcase ventilation system and method for operation thereof.

BACKGROUND AND SUMMARY

In some engines, oil and combustion gases may flow past cylinder in the engine into an unsealed crankcase, thereby increasing vehicle emissions. Therefore, positive crankcase ventilation (PCV) systems have been developed to decrease vehicle emissions. The crankcase ventilation systems may include a sealed crankcase which vents crankcase gas into an intake conduit. At the same time, fresh air may be flowed into the sealed crankcase. In this way, air may be circulated through the crankcase and blow-by gases may be flowed to the intake system to reduce the amount of blow-by gasses emitted from the vehicle.

U.S. Pat. No. 8,347,865 discloses a PCV system including an oil separator in fluidic communication with an oil drain passage flowing oil separated from the blow-by gasses to an oil pan. However, the inventors have recognized several drawbacks with the PCV system disclosed in U.S. Pat. No. 8,347,865. The outlet of the oil drain passage may not be submerged in oil during some operating conditions. For instance, during cornering or other vehicle maneuvers the oil may be moved away from the outlet of the oil drain. Consequently, the oil drain passage may experience elevated pressures and oil may travel up the drain passage and past the oil separator into the intake system, increasing oil consumption in the engine and decreasing combustion efficiency.

The inventors herein have recognized the above issues and developed an engine system. The engine system includes an oil drain passage in fluidic communication with an oil separator. The engine system further includes a backflow valve positioned at an outlet of the oil drain line, the backflow valve having a first configuration where the valve provides a predetermined amount of oil backflow into the oil drain passage and a second configuration where the valve inhibits oil backflow into the oil drain passage.

In this way, a technical result of stopping or inhibiting oil backflow in the oil drain passage may accomplished during certain operating conditions and oil flow may be metered during other operating conditions. In one example, the first and second configurations may be implemented based on pressure in the sealed crankcase. An oil level stick may extend down the oil drain passage. In this way, the amount of oil may be ascertained by the vehicle operation when the backflow valve is in the first configuration. The first configuration may be initiated when a pressure in the crankcase is below a threshold value and the second configuration may be initiated when the pressure is above the threshold value. In this way, oil may flow into the oil drain passage during some conditions, enabling the oil level stick to be used as an oil level indicator and during other conditions oil backflow through the passage may be inhibited to reduce the likelihood of oil traveling through the drain passage into the intake system. As a result, combustion efficiency may be increased. The technical results achieved by the engine system include enabling an oil drain passage to be used for oil level indication as well as for a drain for separated oil and increasing the engine's combustion efficiency by reducing the likelihood of intake air contamination.

The above advantages and other advantages, and features of the present description will be readily apparent from the following Detailed Description when taken alone or in connection with the accompanying drawings.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure. Additionally, the above issues have been recognized by the inventors herein, and are not admitted to be known.

BRIEF DESCRIPTION OF THE DRAWINGS

FIGS. 2-5 are drawn approximately to scale, however other relative dimensions may be used if desired.

DETAILED DESCRIPTION

A positive crankcase ventilation (PCV) system is described herein. The PCV system includes a backflow valve coupled to an outlet of an oil drain passage in a sealed crankcase. The backflow valve is operable in two configurations. The first configuration enables oil backflow into the oil drain passage and the second configuration inhibits oil from entering the oil drain passage. The configurations may be initiated based on the pressure in the sealed crankcase. Specifically, the second configuration may be initiated when the crankcase pressure is above a threshold value and the first configuration may be initiated when the crankcase pressure is below a threshold value. It will be appreciated that in some examples, the aforementioned threshold values may be equivalent. In this way, oil may flow into the oil drain passage during certain conditions, enabling an oil level stick extending through the oil drain passage to be used as an oil level indicator. However, during other conditions, oil backflow through the oil drain passage may be inhibited to reduce the likelihood of oil traveling through the drain passage into the intake system.

Figure 1:
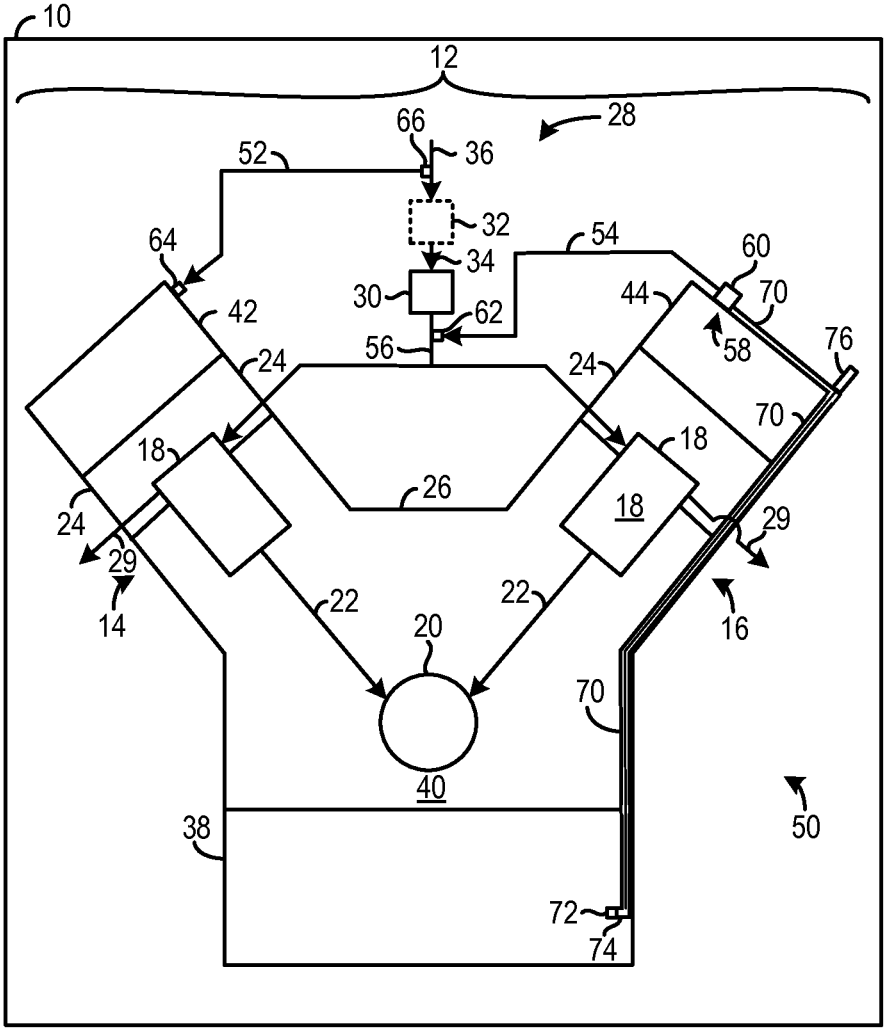
FIG. 1 shows a schematic depiction of a vehicle including an engine system.

FIG. 1 shows a schematic depiction of a vehicle 10 including an engine 12. The engine 12 is configured to implement combustion operation. For example, a four stroke combustion cycle may be implemented including an intake stroke, a compression stroke, a power stroke, and an exhaust stroke. However, other types of combustion cycles may be utilized in other examples.

The engine 12 includes a first cylinder bank 14 and a second cylinder bank 16. However, engines having different cylinder configurations have been contemplated. For instance, the cylinder may be arranged in an inline configuration where the cylinders are arranged in a straight line, a horizontally opposed configuration, etc. Each of the first cylinder bank 14 and the second cylinder bank 16 includes at least one cylinder 18. The cylinders 18 are mechanically coupled to a crankshaft 20. The mechanical coupling is denoted via an arrow 22. The mechanical coupling may be implemented via piston rods, for example.

The engine 12 may include a cylinder head 24 coupled to a cylinder block 26 forming the cylinders 18. An intake system 28 is configured to provide air to the cylinders 18. Likewise, the engine further includes an exhaust system configured to receive exhaust gas from the cylinders 18. Arrows 29 indicate exhaust passages in fluidic communication with the cylinders and included in the exhaust system. Additionally, the intake system 28 may include a throttle 30. The intake system 28 may also include a compressor 32 positioned upstream of the throttle 30. However, in other examples the compressor may not be included in the intake system 28. Further in other examples, the intake system may include two or more compressors.

The compressor 32 may be included in a turbocharger, in one example. Thus, the engine may also include a turbine coupled (e.g., rotationally coupled) to the compressor. The turbine may be configured to receive exhaust gas from the cylinder and convert energy in the exhaust gas to rotation energy and coupled to the compressor. However, in other examples the compressor 32 may be mechanically coupled to a crankshaft, providing what is known as supercharging. The compressor 32 is configured to provide boosted air to the cylinders. As a result, combustion efficiency and/or engine power output may be increased. It will be appreciated that one or more filters may also be included in the intake system upstream of the throttle 30 and compressor 32. Arrow 34 depicts the fluidic communication between the compressor 32 and the throttle 30. However, other intake system 28 configurations have been contemplated. The compressor 32 may be configured to receive air from the surrounding environment, denoted via arrow 36. The arrows 34 and 36 may include one or more intake conduits.

An oil reservoir 38 is coupled to the cylinder block 26. The oil reservoir 38 is configured to store a suitable lubricant (e.g., oil). The oil stored in the oil reservoir 38 may be provided to mechanical components in the engine 12. An oil pump (not shown) may be positioned in the oil reservoir 38. The oil pump may be configured to supply oil to lubricated components in the engine.

The engine 12 further includes a sealed crankcase 40. It will be appreciated that a portion of a boundary of the sealed crankcase 40 may be defined by a housing of the oil reservoir 38. The sealed crankcase 40 includes the crankshaft 20 positioned therein. The sealed crankcase 40 may be substantially sealed from the surrounding environment. It will be appreciated that the sealed crankcase 40 may receive blow-by gasses from the cylinders 18 during engine operation, when cyclical combustion cycles are being implemented.

A first cam cover 42 and a second cam cover 44 are coupled to the cylinder head 24. The cam covers may partially enclose a camshaft having cam lobes configured to actuate valves (e.g., intake and/or exhaust valves) in the engine. However, other cam configurations have been contemplated. It will be appreciated that the interior regions within the cam covers (42 and 44) are in fluidic communication with the sealed crankcase 40.

The engine 12 further includes an engine system 50 (e.g., positive crankcase ventilation (PCV) system). The engine system 50 may be configured to circulate air through a sealed crankcase to decrease the likelihood of blow-by gasses leaking into the surrounding environment. The engine system 50 includes an inlet conduit 52, denoted via an arrow, and an outlet conduit 54, denoted via an arrow. The inlet conduit 52 and the outlet conduit 54 may be referred to as a PCV inlet conduit and a PCV outlet conduit.

The outlet conduit 54 is in fluidic communication with an intake conduit 56 downstream of the throttle 30 and/or compressor 32 and the sealed crankcase 40. Specifically, the outlet conduit 54 includes an inlet 58 opening into an interior region of the camshaft cover 44. The inlet 58 may be included in an oil separator 60. The oil separator 60 is configured to remove oil from gas flowing into the outlet conduit 54. In this way, unwanted oil may be removed from gas flowed into the intake system. Consequently, combustion efficiency is increased and combustion emissions are reduced. In some examples, the outlet conduit 54 may extend through the cylinder head 24 and/or cylinder block 26. The outlet conduit 54 includes an outlet 62 opening into the intake conduit 56. In this way, blow-by gasses from the sealed crankcase 40 may be flowed into the intake system 28.

The inlet conduit 52 is in fluidic communication with the intake conduit 36 upstream of the throttle 30 and/or compressor 32. The inlet conduit 52 also includes an outlet 64 in fluidic communication with the sealed crankcase 40 and opens into an interior region of the camshaft cover 42. As previously discussed, an interior region of the camshaft cover 42 is in fluidic communication with the sealed crankcase 40. The inlet conduit 52 further includes an inlet 66 opening into the intake conduit 36. In this way, fresh air from the intake system may be flowed into the crankcase. Thus, fresh air is provided to the crankcase and blow-by gasses are removed from the crankcase, enabling air circulation in the crankcase. As a result, engine emissions are reduced.

An oil drain passage 70 is coupled to the oil separator 60 and configured to receive oil from the oil separator 60. In this way, oil removed from the circulated gas may be flowed to the oil reservoir 38.

The oil drain passage 70 extends (e.g., traverses) the cam cover 44, the cylinder head 24, the cylinder block 26, and the oil reservoir 38. A backflow valve 72 is coupled (e.g., externally coupled) to an outlet 74 of the oil drain passage 70. Additionally, an oil level stick 76 extends through the oil drain passage 70. The oil level stick 76 may be used to indicate an oil level in the engine. It will be appreciated that the oil level stick 76 may be removed from the oil drain passage 70 by a user and inspected to ascertain an amount of oil in the oil reservoir 38. The aforementioned operation may be carried out during periods of engine shut-down. Therefore, the oil drain passage and the oil level stick may be partially submerged in oil in the oil reservoir 38, during such an operation.

The backflow valve 72 may have a first configuration where the backflow valve provides a metered amount of oil backflow into the oil drain passage and a second configuration where the backflow valve prevents oil backflow into the oil drain passage. In some examples, the aforementioned valve configurations may be passively initiated based on a pressure in the sealed crankcase 40. An example, backflow valve is discussed in greater detail with regard to FIGS. 2-7.

Figure 2:
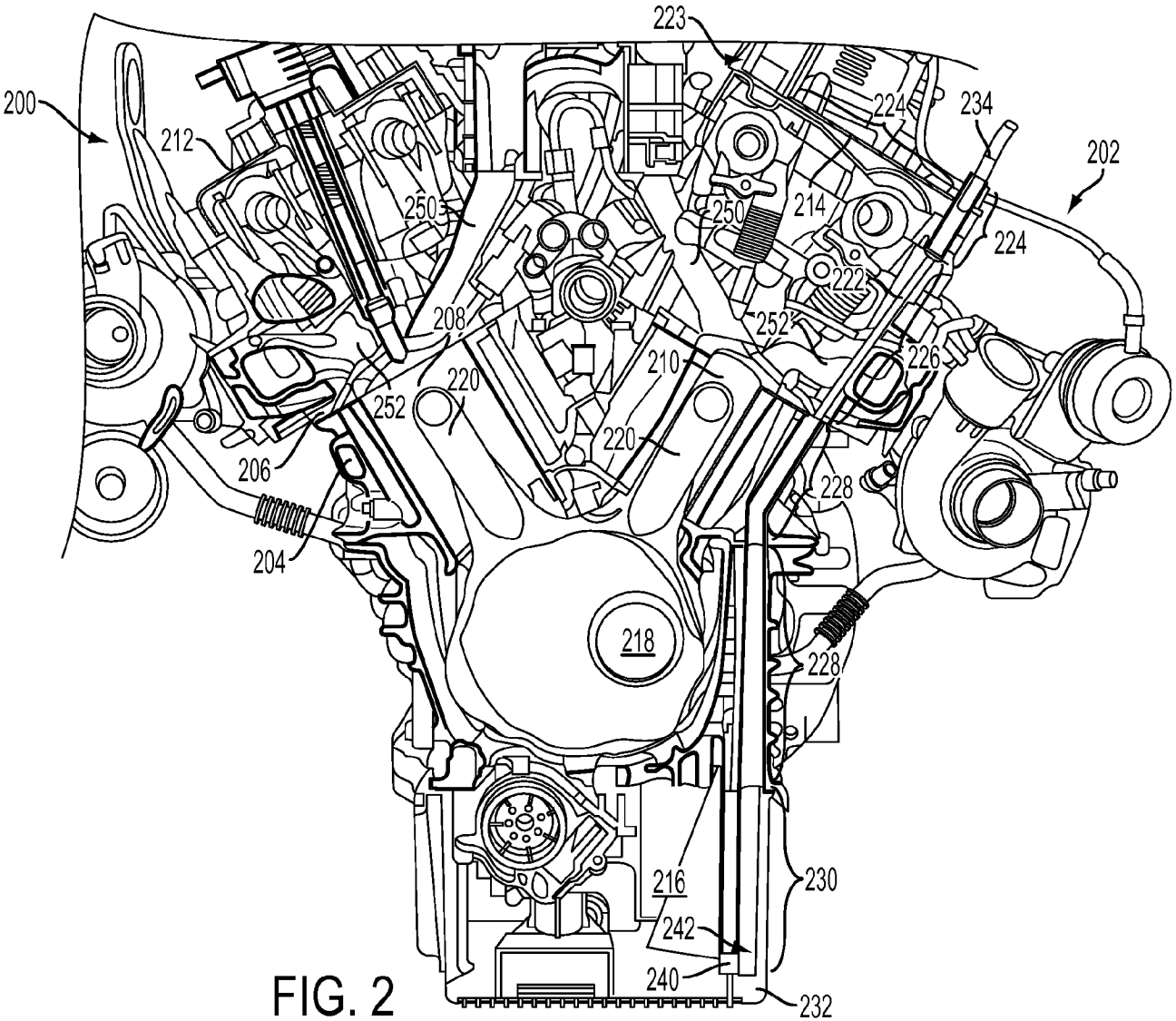
FIG. 2 shows an example engine and engine system.

FIG. 2 shows an example engine 200 and engine system 202. The engine 200 may include similar components to the engine 12 shown in FIG. 1. Likewise, the engine system 202 may include similar components to the engine system 50 shown in FIG. 1. In other words, the engine 200 may be similar to the engine 12, shown in FIG. 1. Likewise, the engine system 202 may be similar to the engine system 50 shown in FIG. 1.

The engine 200 includes a cylinder block 204 and a cylinder head 206. The cylinder block 204 is coupled to the cylinder head 206 forming a first cylinder 208 and a second cylinder 210. The first cylinder 208 may be included in a first cylinder bank and the second cylinder 210 may be included in a second cylinder bank. A first cam cover 212 and a second cam cover 214 are coupled to the cylinder head 206. Specifically, the cam covers are coupled to each of the cylinder banks, respectively. The cam covers may enclose camshafts. The cam covers (212 and 214) may substantially seal the cylinder banks.

The engine system 202 further includes a sealed crankcase 216. A crankshaft 218 is positioned in the sealed crankcase 216. Piston rods 220 couple the cylinders (208 and 210) to the crankshaft 218.

The engine system 202 includes the oil drain passage 222 as discussed above. The oil drain passage 222 is in fluidic communication with an oil separator 223. The oil separator 223 may be similar in functionality to the oil separator 60 shown in FIG. 1. The oil drain passage 222 may be divided into sections. Thus, the oil drain passage 222 includes a first section 224 extending through the cam cover 214, a second section 226 extending through the cylinder head 206, and a third section 228 extending through a cylinder block 204. Additionally, the oil drain passage 222 includes a fourth section 230 extending through a housing of an oil reservoir 232. The oil reservoir housing 232 is coupled to the cylinder block 204. An oil level stick 234 is also shown in FIG. 2. The oil level stick 234 extends through the oil drain passage 222. Thus, the oil level stick may be used as an oil level indicator. In this way, the amount of oil in the oil reservoir may be ascertained by the oil level stick 234.

A backflow valve 240 is coupled to an outlet 242 of the oil drain passage 222. The backflow valve 240 may be similar to the backflow valve 72 shown in FIG. 1. Specifically, the backflow valve 240 may have a first configuration where the backflow valve provides a metered amount of oil backflow into the oil drain passage 222 and a second configuration where the backflow valve prevents oil backflow into the oil drain passage. In some examples, the aforementioned backflow valve configurations may be passively initiated based on a pressure in the sealed crankcase 216. In this way, oil may be permitted into the oil drain passage during certain operating conditions, such as an engine shut-down, enabling the oil level to be ascertained via the oil level stick 234, and inhibited from entering the drain passage during other operating conditions, such as high speed and/or load operation, reducing the likelihood of oil, blow-by gasses, etc., travelling up through the oil drain passage and into the intake system through the oil separator. In this way, the oil drain passage provides the dual use of housing an oil level stick and flowing oil collected at the oil separator. As a result, the compactness of the engine is increased and the likelihood of intake air contamination via oil is reduced.

The engine 200 further includes intake passages 250 each in fluidic communication with one of the cylinders (208 and 210). The engine 200 further includes exhaust passages 252 each in fluidic communication with one of the cylinders (208 and 210). It will be appreciated that the oil separator 223 may be in fluidic communication with one or more of the intake passages 250.

Figure 3:
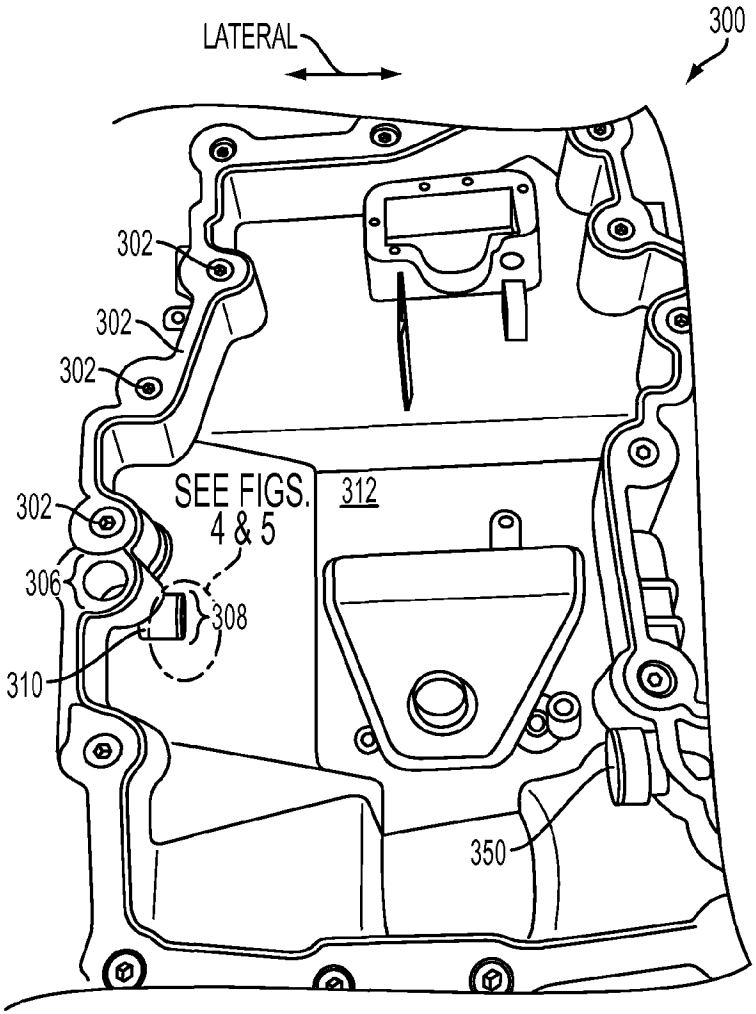

FIG. 3 shows an example oil reservoir 300. The oil reservoir 300 may be similar to the oil reservoir 232 shown in FIG. 2 and the oil reservoir 38 shown in FIG. 1. The oil reservoir 300 includes attachment apparatuses 302 for coupling the oil reservoir 300 to a cylinder block, such as the cylinder block 204 shown in FIG. 2. The attachment apparatuses 302 are included in an attachment interface 304. The attachment interface 304 is a planar surface in the illustrated example. However, other interface contours have been contemplated. An oil drain passage 306 is also shown in FIG. 3. The oil drain passage 306 may be similar to the oil drain passage 222 shown in FIG. 2 and the oil drain passage 70 shown in FIG. 1. As illustrated, a backflow valve 308 is coupled to an outlet of the oil drain passage 306. The backflow valve 308 may be similar to the backflow valve 240 shown in FIG. 2 and the backflow valve 72 shown in FIG. 1. The backflow valve 308 has a first configuration where the backflow valve provides a metered amount of oil backflow into the oil drain passage 306 and a second configuration where the backflow valve prevents oil backflow into the oil drain passage. As previously, discussed the configurations may be implemented (e.g., passively implemented) based on a pressure in a sealed crankcase 312. It will be appreciated that the sealed crankcase 312 may be similar to the sealed crankcase 216 shown in FIG. 2 and the sealed crankcase 40 shown in FIG. 1. Thus, a cylinder block may be coupled to the oil reservoir 300 to enable the crankcase chamber 312 to be substantially sealed.

The backflow valve 308 is laterally arranged in the depicted example. However, other valve orientations have been contemplated. Furthermore, the backflow valve 308 may be submerged in oil, during certain operating conditions. A valve 350 is also shown in FIG. 3. The valve 350 may be a check valve. At least a portion of the components shown in FIG. 3 may be included in the engine system 202 (e.g., PCV system) shown in FIG. 2.

Additionally, the backflow valve 308 is positioned on a lateral side of the oil reservoir 300. Furthermore, the backflow valve 308 may be positioned below a crankshaft in one example. Further, still the backflow valve 308 may be spaced away from a bottom surface of the oil reservoir 300 in one example. Further still, the backflow valve 308 may be positioned between a rear engine cover and a front engine cover in some examples.

Figure 4:
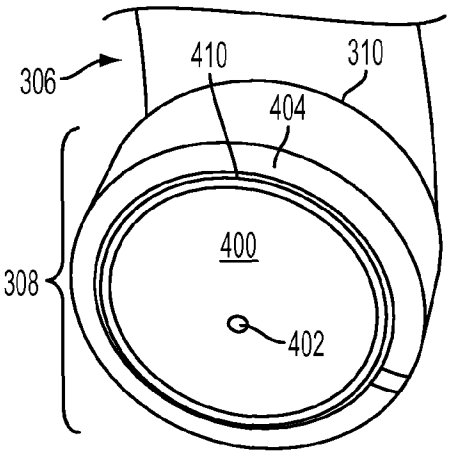
FIGS. 3-7 show different views of an example backflow valve which may be included in the engine systems shown in FIGS. 1 and 2.
Figure 5:
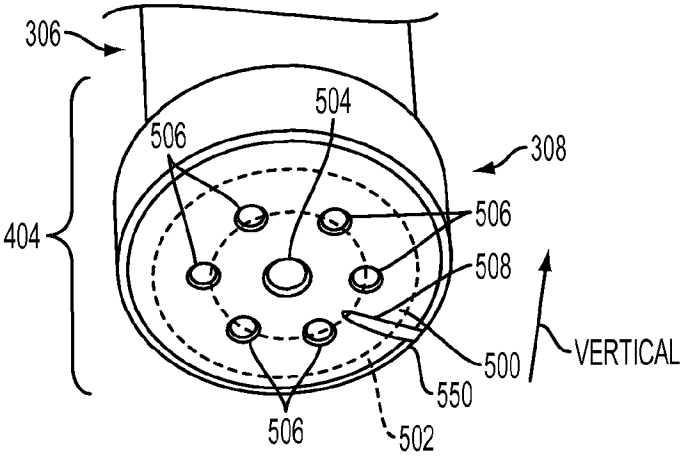

FIGS. 4 and 5 show a detailed view of the backflow valve 308 shown in FIG. 3. Specifically, FIG. 4 shows a dome 400 included in the backflow valve 308. The dome 400 includes a central section 402. The dome 400 is coupled to a sealing element 404. The sealing element 404 is coupled to the outlet 310 of the oil drain passage 306. The backflow valve 308 axially extends beyond the outlet 310 in the depicted example. The dome 400 may include an elastic material (e.g., rubber, elastomeric material, etc.) configured to adjust in geometry based on a pressure applied to the backflow valve 308. The geometric adjustment of the dome 400 may alter the amount of oil permitted to flow into the oil drain passage from the oil reservoir. Specifically, when the geometry dome is altered by a first amount oil may be permitted to flow into the oil drain passage at a metered rate and when the geometry dome is altered by a second amount oil may be substantially inhibited from flowing into the oil drain passage. Specifically in one example, the dome 400 may be curved and the curvature of the dome may vary with the pressure in the sealed crankcase. The dome 400 also includes a peripheral ridge 410 extending around the periphery of the dome. The ridge may provide a desired amount of structural integrity to the dome. In some examples, a portion of the sealing element 404 surrounding the dome 400 may be raised and therefore partially enclose the dome.

FIG. 5 shows the backflow valve 308 shown in FIG. 4 with the dome 400 omitted to reveal the sealing element 404. The sealing element 404 includes a sealing surface 500. The sealing surface is planar in the depicted example. However, other sealing surface contours have been contemplated. A peripheral boundary 502 of the dome 400 shown in FIG. 4 is depicted in FIG. 5. An attachment section 504 of the sealing surface is shown. The attachment section 504 is centrally positioned in FIG. 5. The attachment section 504 may be coupled to an attachment element in the dome 400 shown in FIG. 4. The attachment element in the dome may extend in an axial direction into the attachment section 504.

The sealing element 404 further includes a plurality of openings 506 in fluidic communication with the oil drain passage 306. As previously discussed, the oil drain passage 306 may include an oil level stick extending therethrough and is in fluidic communication with an oil separator. The plurality of openings 506 are circumferentially arranged. That is to say that the center of each openings have the same radius. Each opening 506 is identical in shape and size. Moreover, in the depicted example there are six openings. However, valves with alternate number of openings, alternate opening positions, sizes, and/or geometries have been contemplated. For instance, the size of the openings may vary. Furthermore, the sealing element 404 may have a larger diameter than the outlet 310.

The sealing element 404 includes a backflow groove 508. The backflow groove 508 is radially aligned. Furthermore, the backflow groove 508 tapers along its length and extends to a peripheral edge 550 of the sealing element 404. Therefore, the inlet of the groove may be larger than the outlet of the groove. Furthermore, the depth of the groove may laterally vary or vary along its length in some examples. However, in other examples the depth of the groove may be consistent. The backflow groove 508 allows oil to flow therethrough at a metered rate during certain operating conditions in the sealed crankcase and is discussed in greater detail herein with regard to FIGS. 6 and 7. An outlet of the backflow groove 508 is positioned between two of the openings 506. It will be appreciated that the groove may be machined, cast, molded, etc., into the sealing element.

Figure 6:
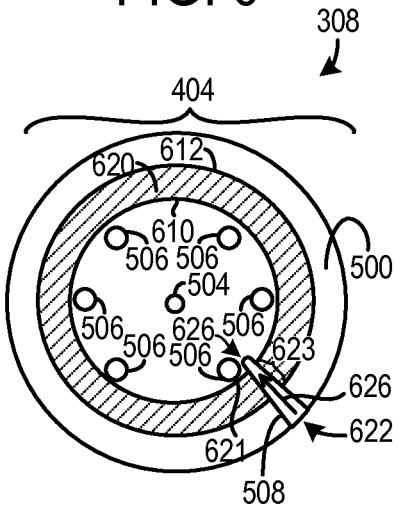
Figure 7:
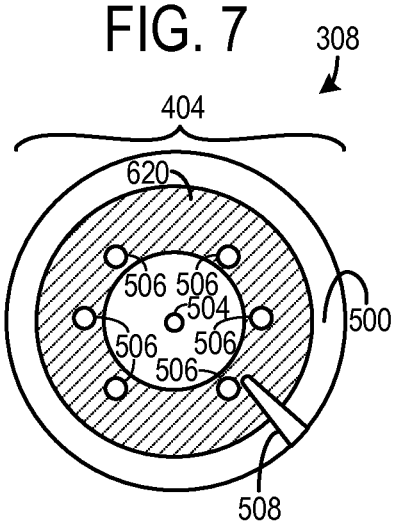

FIGS. 6 and 7 show the backflow valve 308 during different engine operating conditions. Specifically, the backflow valve 308 shown in FIG. 6 is introduced to a pressure less than a threshold value and the backflow valve 308 shown in FIG. 7 is introduced to a pressure greater than a threshold value. It will be appreciated that the pressure introduced to the valve is a pressure in the sealed crankcase 312, shown in FIG. 3. Moreover, the pressure in the sealed crankcase may change based on engine speed, engine boost, etc. In some examples, the aforementioned threshold values may be equivalent. However, in other examples the threshold values may not be equivalent. The threshold pressure value may be −20 kpa to +20 Kpa. It will be appreciated that the pressure introduced to the backflow valve 308 is the pressure inside of the sealed crankcase 312, shown in FIG. 3. The dome 400 in the backflow valve 308 shown in FIGS. and 7 is omitted to reveal the sealing element 404. The sealing element 404 includes the sealing surface 500. The sealing surface 500 is planar in the depicted example. However, alternate sealing surface contours have been contemplated. The attachment section 504, openings 506, and backflow groove 508 are also shown in FIGS. 6 and 7.

A sealing interface 620 is also depicted in FIGS. 6 and 7. The sealing interface 620 shows a region of face sharing contact between an interior surface of the dome 400 shown in FIG. 4 and the sealing surface 500. It will be appreciated that oil may be substantially inhibited from flowing through the region of the sealing interface 620. It will be appreciated that the amount of dome collapse in the valve may determine the size of the sealing interface. The sealing interface is illustrated as having a disk shape. Therefore, an interior region of the dome is not in contact with the sealing surface. It will be appreciated that other sealing interface shapes have been contemplated.

The size of the sealing interface 620 varies between FIGS. 6 and 7. Specifically, the sealing interface 620 shown in FIG. 7 is larger than the sealing interface shown in FIG. 6. It will be appreciated that the increased pressure experienced by the valve in FIG. 7 increases the amount of dome collapse and therefore increases the size of the sealing interface.

As shown, the backflow groove 508 extends through an interior boundary 610 and an exterior boundary 612 of the sealing interface 620. The exterior boundary 612 may be an outer radius of the dome 400, shown in FIG. 4. The backflow groove 508 also extends inside of a radial periphery 621 of one the openings 506. In this way, oil may be flowed from an inlet 622 of the backflow groove 508 to an outlet 624 of the backflow groove and subsequently into the openings 506 at a metered rate. A general oil flow direction through the backflow groove 508 is indicated at 626. In this way, oil may be permitted to travel into the oil drain passage during certain operating conditions, such as engine shut-down. In this way, the oil level may be ascertained via the oil level stick extending through the oil drain passage. In one example, the backflow groove 508 is configured to restrict a back-flow rate through the groove to less than 30 cubic centimeters per minute (cc/min). In one example, the dome 400 shown in FIG. 4, has a first configuration where a surface of a collapsed section of the dome is in face sharing contact with the sealing element 404 radially outside of the radial periphery 621 and extends across an intermediate portion 623 of the back-flow groove 508.

The sealing interface 620 show in FIG. 7 is greater in size than the sealing interface shown in FIG. 6. Specifically, the sealing interface 620 shown in FIG. 7 is expanded in an inward radial direction. The sealing interface shown in FIG. 7 extends over the end (i.e., outlet 624) of the backflow groove 508. Thus in one example, the dome 400 shown in FIG. 4 has a second configuration where a collapsed portion of the dome seals the openings 506 to form the sealing interface 620 over the openings. In this way, oil flow through the backflow groove 508 is substantially inhibited during certain operating conditions such as during high speed, load, and/or boost conditions. Consequently, the likelihood of oil travelling back up through the oil drain passage into the intake system from the oil separator is reduced, thereby increasing combustion efficiency.

The ratio of the length to the width of the backflow groove 508 may be 4 to 1 in one example. Further in some examples, the maximum groove tolerance may be ±0.10 millimeters (mm). Further still in one example, a ratio between the width and the depth of the back-flow groove is 1. Still further in some examples, the sealing element 404 may include a polymeric material and/or a metallic material.

Figure 8:
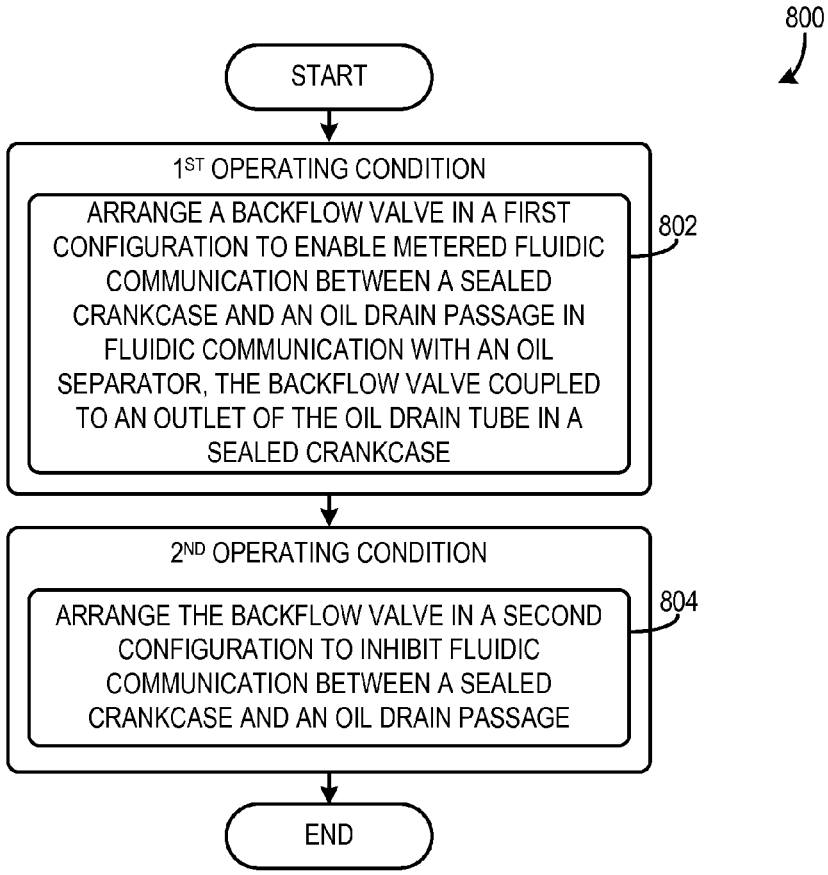
FIGS. 8 and 9 show methods for operation of an engine system.

FIG. 8 shows a method 800 for operation of an engine system. The method may be implemented by the engine system discussed above with regard to FIGS. 1-7 or may be implemented by another suitable engine system.

At 802 the method includes arranging a backflow valve in a first configuration to enable metered fluidic communication between a sealed crankcase and an oil drain passage in fluidic communication with an oil separator, the backflow valve coupled to an outlet of the oil drain passage in a sealed crankcase.

Next at 804 the method includes arranging the backflow valve in a second configuration to inhibit fluidic communication between a sealed crankcase and an oil drain passage. Step 802 is implemented during a first operating condition and step 804 is implemented during a second operating condition different than the first operating condition. In one example, the first operation condition, may be when a crankcase chamber pressure is below a threshold value. In another example, the second operating condition may be when a crankcase chamber pressure is above a threshold value. Further in another example, an oil level stick may extend through a portion of the oil drain passage. In an additional example, the backflow valve may be passively arranged in the first configuration and the second configuration.

Figure 9:
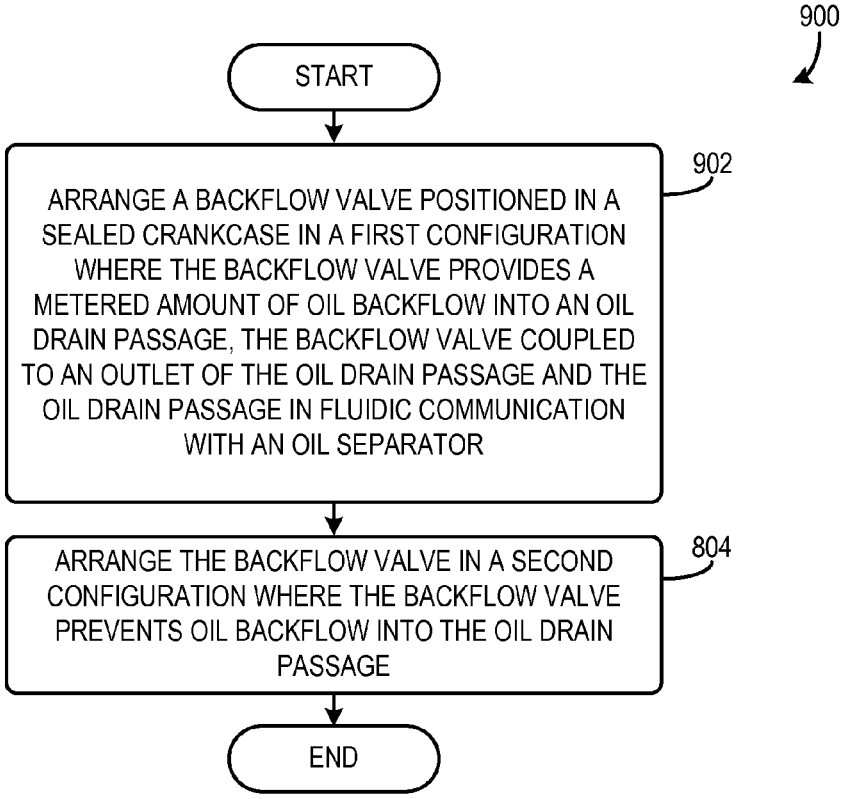

FIG. 9 shows a method 900 for operation of an engine system. The method 900 may be implemented by the engine systems discussed above with regard to FIGS. 2-7 or by another suitable engine system.

At 900 the method includes arranging a backflow valve positioned in a sealed crankcase in a first configuration where the backflow valve provides a metered amount of oil backflow into an oil drain passage, the backflow valve coupled to an outlet of the oil drain passage and the oil drain passage in fluidic communication with an oil separator.

Next at 904 the method includes arranging the backflow valve in a second configuration where the backflow valve prevents oil backflow into the oil drain passage.

In one example, the first configuration and the second configuration are implemented during a first operating condition and a second operating condition. Further in one example, the first operating condition is when a pressure of the sealed crankcase is below a threshold value. Further, in one example the second operating condition is when the pressure in a sealed crankcase is above a threshold value. Still further in one example the backflow valve is positioned downstream of an oil level stick positioned in the oil drain passage. Additionally in one example the backflow valve is externally coupled to the oil drain passage outlet. Further in one example, the first configuration restricts a back-flow rate to less than 30 cubic centimeters per minute (cc/min).

Note that the example control and estimation routines included herein can be used with various engine and/or vehicle system configurations. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method for operation of an engine system comprising:

arranging a backflow valve positioned in a sealed crankcase in a first configuration where the backflow valve provides a metered amount of oil backflow into an oil drain passage from an oil reservoir in the sealed crankcase, the backflow valve coupled to an outlet of the oil drain passage to the oil reservoir and the oil drain passage in fluidic communication with an oil separator; and arranging the backflow valve in a second configuration where the backflow valve prevents oil backflow into the oil drain passage from the oil reservoir.

2. The method of claim 1, where the first configuration and the second configuration are implemented during a first operating condition and a second operating condition.

3. The method of claim 2, where the first operating condition is when a pressure of the sealed crankcase is below a threshold value and second operating condition is when the pressure in the sealed crankcase is above the threshold value.

4. The method of claim 2, where the first operating condition is during an engine shut-down and the second operating condition is during one or more of high speed, load, and boost conditions.

5. The method of claim 2, where the backflow valve is positioned downstream of an oil level stick positioned in the oil drain passage, wherein the oil drain passage traverses a cam cover, cylinder head, cylinder block, and oil reservoir of the engine system, wherein a housing of the oil reservoir is coupled to the cylinder block, and wherein the backflow valve extends beyond the outlet into the oil reservoir.

6. The method of claim 1, where the backflow valve is externally coupled to the oil drain passage outlet and wherein the backflow valve is positioned below a crankshaft and on a lateral side of the oil reservoir.

7. The method of claim 1, where the first configuration restricts a back-flow rate to less than 30 cubic centimeters per minute (cc/min).

8. A backflow valve in an engine system comprising:

a sealing element coupled to an oil drain passage outlet in a sealed crankcase, the sealing element including a back-flow groove and at least one opening in fluidic communication with the oil drain passage outlet; and a dome positioned over and coupled to a surface of the sealing element at an interior surface of the dome, around a circumference of a peripheral boundary of the dome, the back-flow groove extending outside of an outer radius of the dome and inside of a radial periphery of the at least one opening.

9. The backflow valve of claim 8, where the shape of the dome and a sealing interface between the sealing element and dome varies based on a pressure in the sealed crankcase, wherein the sealing interface is a region of face sharing contact between the interior surface of the dome and the surface of the sealing element, where the surface of the sealing element is a planar sealing surface, and wherein the dome is further coupled to the sealing element at an attachment element of the dome, the attachment element of the dome extending in an axial direction from the interior surface into a centrally positioned attachment section of the sealing surface.

10. The backflow valve of claim 9, where the dome has a first configuration where a surface of a collapsed section of the dome is in face sharing contact with the sealing surface of the sealing element radially outside of the radial periphery of the at least one opening and extends across an intermediate portion of the back-flow groove, where the sealing interface has a disk shape.

11. The backflow valve of claim 10, where the dome has a second configuration where a collapsed portion of the dome is in face sharing contact with the sealing surface of the sealing element and seals the at least one opening to form the sealing interface over the at least one opening, and wherein the oil drain passage outlet is an outlet to an oil reservoir of the sealed crankcase, the oil reservoir coupled to a cylinder block.

12. The backflow valve of claim 11, where a size of the sealing interface between the dome and the sealing surface of the sealing element in the first configuration is less than a size of the sealing interface in the second configuration, wherein the sealing interface in the second configuration is expanded in an inward radial direction, relative to a center of the sealing element, from the sealing interface in the first configuration, and wherein the backflow valve extends beyond the oil drain passage outlet into the oil reservoir of the sealed crankcase.

13. The backflow valve of claim 9, where a ratio between a width and a depth of the back-flow groove is 1, wherein the back-flow groove is radially aligned and tapers along its length, where an inlet of the back-flow groove at a peripheral edge of the sealing element is larger than an outlet of the back-flow groove at a radial position of the at least one opening.

14. The backflow valve of claim 9, where the dome is curved and the curvature of the dome varies with the pressure in the sealed crankcase, and wherein the dome includes an elastic material.

15. The backflow valve of claim 8, further comprising a plurality of openings arranged circumferentially around the sealing element and in fluidic communication with the oil drain passage and wherein an outlet of the back-flow groove is positioned between two of the plurality of openings and an inlet of the back-flow groove is positioned at a peripheral edge of the sealing element.

16. A method for operation of an engine system comprising:

during a first operating condition, arranging a backflow valve in a first configuration to enable metered fluidic communication from an oil reservoir of a sealed crankcase and to an oil drain passage in fluidic communication with an oil separator, the backflow valve coupled to an outlet of the oil drain passage to the oil reservoir in the sealed crankcase; and during a second operating condition, arranging the backflow valve in a second configuration to inhibit fluidic communication from the oil reservoir of the sealed crankcase and to the oil drain passage.

17. The method of claim 16, where the first operating condition is when a crankcase chamber pressure is below a threshold value and the second operating condition is when a crankcase chamber pressure is above the threshold value.

18. The method of claim 16, where the oil drain passage extends through a cam cover, cylinder head, cylinder block, and housing of the oil reservoir in the engine system, wherein the backflow valve is submerged in oil in the oil reservoir during certain operating conditions, and wherein the backflow valve is positioned below a crankshaft.

19. The method of claim 16, where an oil level stick extends through a portion of the oil drain passage and wherein the backflow valve axially extends beyond the outlet of the oil drain passage.

20. The method of claim 16, where the backflow valve is passively arranged in the first configuration and the second configuration based on pressure in the sealed crankcase, wherein the outlet of the oil drain passage is positioned within the oil reservoir, and wherein the oil reservoir further includes a check valve.

* * * * *